United States Patent [19]

Inowa et al.

[11] Patent Number: 4,568,175

[45] Date of Patent: Feb. 4, 1986

[54] BLADE CLEANING DEVICE

[75] Inventors: Shigeru Inowa, Hino; Takashi Ito, Tokyo; Mitsugu Nemoto, Hachioji, all of Japan

[73] Assignee: Konishiroku Photo Industry Co., Ltd., Tokyo, Japan

[21] Appl. No.: 541,279

[22] Filed: Oct. 12, 1983

[30] Foreign Application Priority Data

Oct. 20, 1982 [JP] Japan ..... 57-185082

[51] Int. Cl.[4] ..... G03G 21/00

[52] U.S. Cl. ..... 355/15; 118/652; 15/256.51

[58] Field of Search ..... 355/15, 3 R; 118/652; 15/256.5, 256.51, 256.52

[56] References Cited

U.S. PATENT DOCUMENTS

| | | | |
|---|---|---|---|
| 4,334,766 | 6/1982 | Sugiyama et al. | 355/15 |
| 4,396,276 | 8/1983 | Murasaki | 355/15 |
| 4,451,139 | 5/1984 | Yanagawa et al. | 355/15 |

*Primary Examiner*—R. L. Moses

*Attorney, Agent, or Firm*—Frishauf, Holtz, Goodman & Woodward

[57] ABSTRACT

A blade cleaning device for removing toners remaining on a surface of a photoreceptor comprises a blade and a blade holding frame. The blade holding frame is rotatable in substantially parallel with a plane containing a center of the photoreceptor and a contact line of the blade with the photoreceptor.

16 Claims, 5 Drawing Figures

BLADE CLEANING DEVICE

BACKGROUND OF THE INVENTION

Field of the Invention

This invention relates to a blade cleaning device for an electrophotographic image forming apparatus and more particularly to a blade cleaning device for cleaning off toners remaining on the surface of an electrophotoreceptor by applying the edge of a cleaning blade to the surface of the photoreceptor.

Generally in an electrophotographic image forming apparatus such as an electrophotographic copier, a rotatable photoreceptor having an image retaining member such as a photoconductive layer is formed in a drum shape to form a copy image from an original. In the abovementioned apparatus, an electrically charging means, an exposing means, and a developing means are arranged respectively around the circumference of the rotating photoreceptor and an electrostatic latent image is thereby formed according to an original image and the latent image is developed with developer containing toner. Thereafter, the visible image thus obtained by the development on the photoreceptor is electrostatically transferred to a transfer material such as a plain paper and the visible toner image is fixed onto the transfer material. In the meantime, the remaining toner is removed from the photoreceptor after transfer by means of a cleaning means so that the apparatus may be ready for the succeeding image formation.

Heretofore, blade cleaning apparatus has been widely used to serve as the cleaning means. In a blade cleaning method, an elastic member such as an urethane rubber plate is brought into pressure contact with a photoreceptor surface. Specifically one side of the elastic member is supported by a holding member and the edge portion on the opposite side of the elastic member is brought into pressure contact with the photoreceptor surface by utilizing elasticity of the elastic member. The photoreceptor surface and the edge portion of the elastic member are moved relatively, and thus the residues such as toner on the photoreceptor surface are cleaned off from the photoreceptor surface.

This method is characterized in that the cleaning performance is superior to the other cleaning method, the residual amount of toner can be reduced after cleaning, and the cleaning performance thereof can be maintained for a long period of time.

It is, however, not easy to bring a blade into even pressure contact with the surface of the photoreceptor and therefore partial cleaning failure occurs very frequently.

Blade cleaning apparatus having been used so far comprises a cleaning blade, a holding member or a holding frame for holding the cleaning blade and a mechanism for bringing the cleaning blade into pressure contact uniformly with a photoreceptor through the holding member. To the cleaning blade itself, a very careful attention has been paid and inter alia to the mechanical accuracy and the elasticity thereof.

With the holding member, the blade is held thereby in the direction of the thickness of the blade and the holding member is provided on the perimeter of the center portion thereof with a rotatable member such as a rotatable shaft or ratatable hole, in the longitudinal direction of the blade.

In the blade pressing mechanism, the blade is brought into pressure contact with the photoreceptor surface with a suitable pressure and with the support of the holding frame, and the edge of the blade is positioned so as to make the blade fit with the surface by making an suitable angle to the photoreceptor surface.

FIG. 1 illustrates a method for holding is conventional type of blade, which is described in Japanese Patent Publication Open to Public Inspection No. 43342/1973. FIG. 1 is a cross-sectional view showing the central portion of a drum taken from the rectangular direction to the drum shaft. Numeral 1 is a cylindrical photoreceptor drum rotatable around a rotation axis $\mathbf{1}_0$. 2 is a plate-shaped elastic blade which is held by a holding frame comprising support plates 3 and 4 so that the blade and the holding frame can be united in a body. Hole 31 is provided on the perimeter of the central portion of the support plate 3 in the longitudinal direction, i.e., in the vertical direction in the drawing. The holding member is arranged to be rotatable by fitting the hole 31 to the shaft 5 of the blade pressing mechanism. As stated above, the shaft 5 has so far been positioned vertically to the plane of a blade, for the convenience of fitting. Namely, blade 4 has been designed so as to be able to rotate in parallel with the horizontal plane taken on line h—h. On the other hand, the plane taken on shaft $\mathbf{1}_0$-contact line $\mathbf{1}_a$ of blade 2 with photoreceptor 1 has been positioned so as to make an angle of $\theta°$ with the horizontal plane. There has been almost no study on an angle of $\theta°$ made between the rotation surface (in parallel with the plane h—h) of the blade 2 and the plane taken on the contact line $\mathbf{1}_a$—the shaft $\mathbf{1}_0$.

SUMMARY OF THE INVENTION

It is an object of the invention to provide a blade cleaning device in which a uniform and excellent pressure contact of the edge of a blade with the surface of a photoreceptor drum can be attained, and a stable and excellent cleaning can be also attained without causing any partial cleaning failure.

A blade cleaning device of the invention comprises a blade for removing toners remaining on the curvature-having photoreceptive surface of a photoreceptor having a curvature in at least one part thereof, wherein a holding member for holding the blade is rotatable in almost parallel with the plane containing the center of curvature of the photoreceptive surface of the photoreceptor and contact line of the blade with the photoreceptive surface.

DESCRIPTION OF THE PREFERRED EMBODIMENTS

Figure 1:
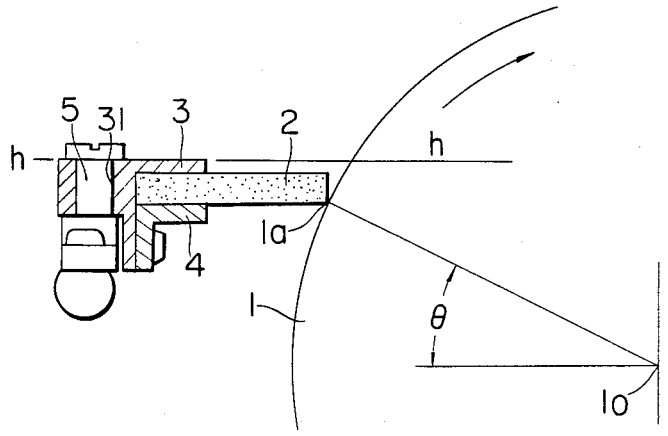
FIG. 1 is a cross-sectional view of the central portion of a drum taken on a line rectangular to a drum shaft, showing how to support a conventional blade cleaning device.
Figure 2:
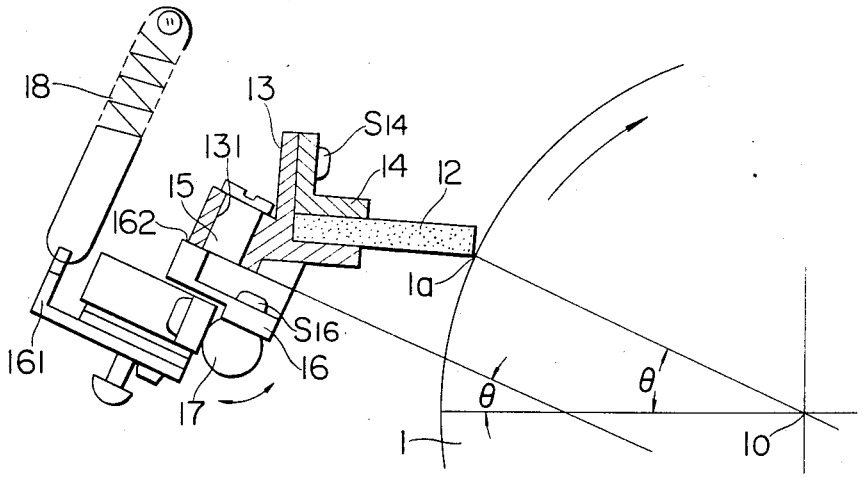
FIG. 2 is a cross-sectional view of the central portion of a drum taken on a line rectangular to the drum shaft, showing a blade cleaning device of the invention.

In FIG. 2, 1 is a cylindrical photoreceptor drum rotating around a shaft $\mathbf{1}_0$. 12 is a plate-shaped elastic blade made of a material such as urethane rubber suitable for cleaning off residual toners adhered on the surface of the photoreceptor drum 1. Blade 12 is sandwiched by support plates 13, 14 so as to be held in a body by small screw S14 or the like. The support plates 13, 14 are arranged for sandwiching the blade 12 so that they may be united in a body and may serve as a holding frame for the blade 12. Hole 131 is provided on the longitudinal perimeter of the support plate 13.

On the other hand, in a blade pressing mechanism, a cleaning assembly fitting member 16 is fitted to a swingable and rotatable shaft 17 by means of a small screw S16. Shaft 17 is pivotally supported so that it may well keep parallel to the shaft $1_0$ of the photo-receptor drum 1.

Spring fitting arm 161 which is a part of the cleaning assembly fitting member 16 is provided with one end of an elastically energized spring 18. The cleaning assembly fitting member 16 is also provided with a blade assembly fitting face 162 corresponding to the perimeter of the center portion of the photoreceptor drum in the longitudinal direction of the drum. On the blade fitting face, a blade assembly fitting shaft 15 is provided perpendicularly to the face thereof.

The blade assembly fitting shaft 15 of the blade pressing mechanism is fitted in the hole 131 of the support plate 13 of the holding frame, and thus the blade 12 which is united with the support plates 13, 14 in a body is made rotatable around the blade assembly fitting shaft 15.

The blade cleaning device having such a structure as mentioned above is motivated to be rotatable clockwise around the shaft 17 by means of the energized spring 18, so that the edge of the blade 12 is brought into contact with the circumferential surface of the photoreceptor drum 1 on the contact line 1*a*.

In the invention, when the plane including the contact line 1*a* and the shaft 1*o* of the photoreceptor drum 1 in this state makes an angle of $\theta$ to the horizontal plane, the described blade fitting face 162 is provided in advance so as to also make an angle of $\theta$ approximately to the horizontal plane. Accordingly, the edge of the blade 12 is pressed by the spring 18 and is rotated around the blade assembly fitting shaft 15 on the plane including the contact line 1*a* and the shaft 1*o*, and the edge of the blade 12 comes into pressure contact with the photoreceptor drum 1 on the contact line 1*a* with a given uniform partial pressure so that residual toners adhered on the circumferential surface of the photoreceptor drum 1 are uniformly cleaned off according to the rotation of the photoreceptor drum 1.

As compared with the conventional blade holding methods, the invention can have the greater effect that a blade edge can come into contact with the circumferential surface of a photoreceptor drum with a uniform partial pressure and can also readily follow the surface undulation or the cylindrical deviation of the photoreceptor drum.

Figure 3A:
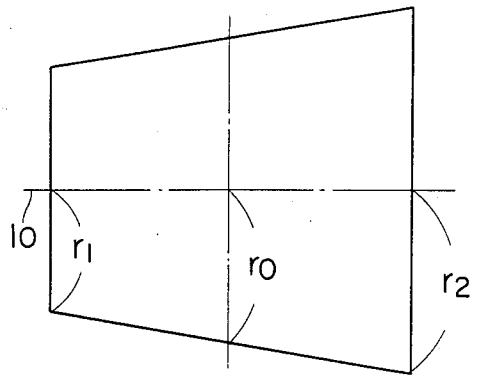
FIG. 3 is an illustration showing the effects of the invention.
Figure 3B:
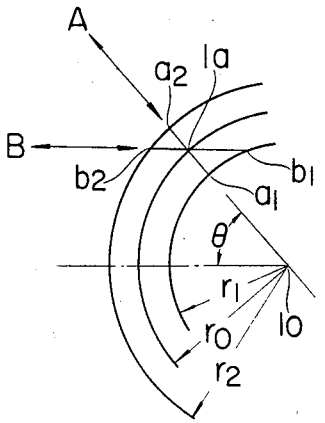
Figure 3C:
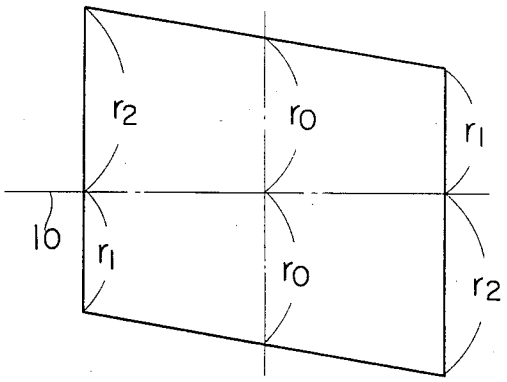

FIG. 3 illustrates the consideration of the reason why the effect can be obtained. There are some instances where a photoreceptor drum may have the form of a circular cone as shown in FIG. 3 (*a*) but not the form of a cylinder.

If the radius of a drum in the center portion in the axial direction is represented by $r_0$ and the radius of the drum at the both ends are represented by $r_1$, $r_2$ respectively and the relation thereof is $r_2-r_0=r_0-r_1$, then the center portion of the blade in the longitudinal direction comes into contact with the line 1*a* on the radius $r_0$ not only in the invention but the conventional techniques [See FIG. 3 (*b*)].

In the invention, the blade rotates in the direction of the arrow A, so that the both ends come into contact with $a_1$, $a_2$ on the radiuses $r_1$, $r_2$ respectively. On the other hand, in the conventional techniques, blade rotates in the direction of the arrow B, so that the both ends of the blade come into contact with $b_1$, $b_2$ on the radiuses $r_1$, $r_2$ respectively. The equation is $a_1$1 a=1 a $a_2$ in the invention, so that both ends of a blade can follow the surface of a drum without any difficulty and can come into contact with the surface with a uniform partial pressure.

In the conventional techniques, however, it is obvious that the equation is $b_1$1 a≠1 a $b_2$ and a blade is rotated in the direction of the horizontal axis B. Therefore the blade does not come into uniform contact with the surface of the drum and gives an insufficient pressure contact at one of the both ends of the blade ($b_1$ in the drawing), so that a cleaning failure is caused partially.

In the case that a rotation shaft is eccentric to a cylinder as shown in FIG. 3(*c*), what is described above is also proved approximately and the effects of the invention can be obtained.

As is obvious from the above descriptions, the difference of the effects between the invention and the conventional techniques becomes more remarkable when a plane including a contact line and drum shaft makes an angle of $\theta$ to the horizontal plane closer to 90°, and further more remarkable when the elasticity of the blade or the hardness of rubber thereof in particular is large. In the invention, therefore, the freedom of selection of materials such as blade materials can be broadened and the cleaning effects can also be more obtained by means of a blade cleaning. Further, in the invention a various means and methods for operating the cleaning apparatus can be adapted. For example, there is described in Japanese laid open to public patent No. 147047/1979 a method for cleaning off toners remaining on the surface of a photosensitive drum wherein a cleaning blade is brought into pressure contact with the drum surface at least before the movement of the drum and detached from the drum surface after the end of the reproducing cycle and the stop of the movement of the drum.

Another example is described in Japanese patent application No. 190167/1982. Therein, the cleaning blade is brought into pressure contact with the drum surface during copying, and is detached from the drum surface when the copying process doesn't start again from the completion of the copy numbers until elapsing of predetermined time. The time is determined from a point of view such as time required for changing the originals and time required for changing of the operators.

What is claimed is:

1. A blade cleaning device for removing residual toners remaining on a curved photoreceptive surface of a rotatable photoreceptor, said curved photoreceptive surface having a center of curvature, the blade cleaning device comprising:

a blade member for removing said residual toners from said photoreceptive surface, said blade member having a contact edge;

holding means for rigidly holding said blade member;

support means coupled to said holding means for supporting said blade member so that it can be brought into contact with said photoreceptive surface of said photoreceptor along a contact line on said photoreceptive surface, said support means being rotatable about a given axis which is substantially parallel with the axis of rotation of said photoreceptor;

urging means coupled to said support means for urging said support means to rotate about said given axis so as to urge and bring said blade member into pressure contact with said curved photoreceptive surface of said photoreceptor; and said support means being arranged at an inclination to the horizontal plane so that the contact edge of said blade member is moveable on a plane defined by the contact line and the center of curvature of said curved photoreceptive surface, whereby uniform pressure contact of said contact edge of said blade member against said curved photoreceptive surface is provided along said contact line.

2. The blade cleaning device of claim 1, wherein said center of said curvature comprises a rotatable shaft of said photoreceptor.

3. The blade cleaning device of claim 1, wherein said holding means includes a shaft-receiving hole therein, and said support means includes a fitting shaft engaged with said hole of said holding means so that said holding means is rotatable about said fitting shaft relative to said support means.

4. The blade cleaning device of claim 3, wherein a plane including said contact line and center of curvature of said curved photoreceptive surface is set at a given angle relative to the horizontal plane.

5. The blade cleaning device of claim 4, wherein said given angle is about 90°.

6. The blade cleaning device of claim 1, wherein a plane including said contact line and center of curvature of said curved photoresistive surface is set at a given angle relative to the horizontal plane.

7. The blade cleaning device of claim 6, wherein said given angle is about 90°.

8. The blade cleaning device of claim 1, wherein said urging means comprises a resilient spring coupled to said support means laterally spaced from said given axis.

9. A blade cleaning device for removing residual toners remaining on a curved photoreceptive surface of a rotatable photoreceptor, said curved photoreceptive surface having a center of curvature, the blade cleaning device comprising:

a blade member for removing said residual toners from said photoreceptive surface, said blade member having a contact edge;

holding means for rigidly holding said blade member;

mounting means coupled to said holding means and defining a rotation axis about which said holding means and said blade member are rotatable;

urging means for urging and bringing said blade member into pressure contact with said curved photoreceptive surface of said photoreceptor; and said rotation axis of said mounting means being arranged at an inclination to the horizontal plane so that the contact edge of said blade member is moveable on a plane defined by the contact line and the center of curvature of said curved photoreceptive surface, whereby uniform pressure contact of said contact edge of said blade member against said curved photoreceptive surface is provided along said contact line.

10. The blade cleaning device of claim 9, wherein said center of said curvature comprises a rotatable shaft of said photoreceptor.

11. The blade cleaning device of claim 9, wherein said holding means includes a shaft-receiving hold therein, and said mounting means includes a fitting shaft defining said rotation axis and engaged with said hole of said holding means so that said holding means is rotatable about said fitting shaft relative to said mounting means.

12. The blade cleaning device of claim 11, wherein a plane including said contact line and center of curvature of said curved photoreceptive surface is set at a given angle relative to the horizontal plane.

13. The blade cleaning device of claim 12, wherein said given angle is about 90°.

14. The blade cleaning device of claim 9, wherein a plane including said contact line and center of curvature of said curved photoreceptive surface is set at a given angle relative to the horizontal plane.

15. The blade cleaning device of claim 14, wherein said given angle is about 90°.

16. The blade cleaning device of claim 9, wherein said urging means comprises a resilient spring coupled to said mounting means literally spaced from said rotation axis.

* * * * *